United States Patent [19]

Lanno

[11] 4,030,638

[45] June 21, 1977

[54] FLUID DISPENSER SYSTEM

[76] Inventor: Joseph P. Lanno, 20 Beacon St., Newton, Mass. 02167

[22] Filed: June 1, 1976

[21] Appl. No.: 691,386

[52] U.S. Cl. ..... 222/180; 239/274

[51] Int. Cl.[2] ..... B05B 12/02

[58] Field of Search ..... 239/274, 289; 222/180, 222/183, 394, 402.15, 181, 160

[56] References Cited

UNITED STATES PATENTS

| | | | |
|---|---|---|---|
| 1,214,149 | 1/1917 | Fraad | 239/274 X |
| 1,476,930 | 12/1923 | Stuerzer | 239/274 |
| 2,178,888 | 11/1939 | Feldstein | 239/274 X |
| 2,180,967 | 11/1939 | Strobel | 239/274 X |
| 3,182,857 | 5/1965 | Bischoff et al. | 222/180 X |
| 3,269,601 | 8/1966 | Weber | 222/180 X |

FOREIGN PATENTS OR APPLICATIONS

| | | | |
|---|---|---|---|
| 278,102 | 9/1967 | Australia | 222/180 |
| 1,147,976 | 6/1957 | France | 239/274 |
| 1,151,924 | 8/1957 | France | 239/274 |

*Primary Examiner*—Evon C. Blunk
*Assistant Examiner*—Michael Mar
*Attorney, Agent, or Firm*—Joseph S. Iandiorio

[57] ABSTRACT

A periodically actuated fluid dispenser system, driven by a door-closer unit having an output shaft driven by motion of an associated door including a drive unit having a cam member and an input drive member driven by the output shaft to rotate the cam member; a fluid dispenser container; and a cam follower actuator responsive to the cam member for operating the fluid dispenser container for dispensing the fluid at least once during each rotation of the cam member.

2 Claims, 5 Drawing Figures

FLUID DISPENSER SYSTEM

FIELD OF INVENTION

This invention relates to a periodically actuated fluid dispenser system, and more particularly to such a system driven by a door-closer unit through motion of a door.

BACKGROUND OF INVENTION

There are a number of mechanisms for automatically dispensing fluids, such as deodorants, disinfectants, insecticides and the like. One such mechanism uses a synchronised motor to periodically operate an aerosol dispenser. Another type uses the movement generated by the withdrawal of a towel from a towel dispenser to mechanically drive a fan to move air over a block of deodorant and into a room. Other types use the motion of a door to operate a mechanical drive which moves air across a deodorant and into a room. Yet others use special mechanical linkages such as toggles and bellows to operate valves and aerosol devices. Typically, the mechanism operated by the motion of an associated door causes the fluid to be dispensed each time the door is opened and/or closed, which is often more frequently than is required. Too frequent dispensing of the fluid, especially pesticides, insecticides and other harmful substances may be undesirable and injurious to persons working in the area; when used in and near a kitchen or other food-preparing facility there is a danger of contamination of the food being prepared. Some devices are operated by an electric motor or some other means which requires a more expensive and complex arrangement.

SUMMARY OF INVENTION

It is therefore an object of this invention to provide a simple, efficient, inexpensive and economical fluid dispenser system which is periodically operated through a door-closer unit by the action of a door.

It is a further object of this invention to provide such a fluid dispenser system which may be actuated to dispense fluid for each predetermined number of times that the associated door-closer unit is operated by the opening and closing of the door.

It is a further object of this invention to provide a system in which the motion of a door operates a mechanical drive to periodically operate an aerosol valve to dispense fluid.

The invention features a periodically actuated fluid dispenser system driven by a door-closer unit having an output shaft driven by motion of an associated door. It includes a drive unit having a cam member, and an input drive member driven by the output shaft to rotate the cam member. There is a fluid dispenser container. A cam follower actuator is responsive to the cam member for operating the fluid dispenser container to dispense fluid at least once during each rotation of the cam member.

In preferred embodiments, the cam member is driven through only a portion of the full rotation upon each operation of the output shaft of the door-closer unit, and the output shaft is driven through only a portion of its rotation each time the door-closer unit is operated by the opening and closing of the door.

DISCLOSURE OF PREFERRED EMBODIMENT

Other objects, features and advantages will occur from the following description of a preferred embodiment and the accompanying drawings in which.

The periodically actuated fluid dispenser system according to this invention may be driven by an output shaft of a door-closer unit which in turn is driven by the opening and closing motions of the associated door. The fluid dispenser system may include a drive unit having a cam member and an input drive member driven by the output shaft of the door-closer unit to rotate the cam member. The cam member may be fixed to the input drive member or it may be separated by one or more gears arranged in the nature of a gear train. The drive unit, including the cam member and input drive member, are typically located in a housing along with a fluid dispenser container and a cam follow actuator, which is responsive to the cam member to operate the fluid dispenser container to dispense fluid at least once during each rotation of the cam member. The drive unit may include gears and belts and various other types of drive mechanisms to communicate the drive from the output shaft of the door-closer to the cam member.

The output shaft rotates in one direction for a portion of the full rotation when the door is opened and rotates the same amount in the opposite direction as the door is closed. For this reason the input drive member may include a ratchet mechanism responsive to the bidirectional, self-cancelling motion of the door-closer unit output shaft to produce unidirectional motion at its input shaft. The output shaft of the input drive member may rotate only one-quarter of a rotation each time the door is opened and closed, so that the cam member completes one rotation for every four times the door is opened and closed. In this manner, the fluid will be dispensed from the fluid dispenser container only once every fourth time the door is operated. The frequency of operation of the dispenser container may be varied by changing the ratio of door closings to cam member rotation so that, for example, for each quarter rotation of the output shaft the cam member rotates through one-half full rotation or a full rotation or two or three times the full rotation. Alternatively, the cam member may be made to have a number of lobes so that it causes dispension of the fluid in the dispenser container more than once during each rotation of the cam member.

Preferably, the cam member may be used to normally oppose the force on the cam follower actuator, exerted by a spring attached to the cam follower actuator, which urges it toward operating the fluid dispenser container, so that the cam member permits the spring to overcome the opposing cam force during only a brief period of the rotation of the cam member. However, the cam member may be constructed and arranged so that the spring or other biasing device prevents the cam follower actuator from operating the fluid dispenser container until overcome by the force of the cam member during a specific portion of its rotation.

Figure 1:
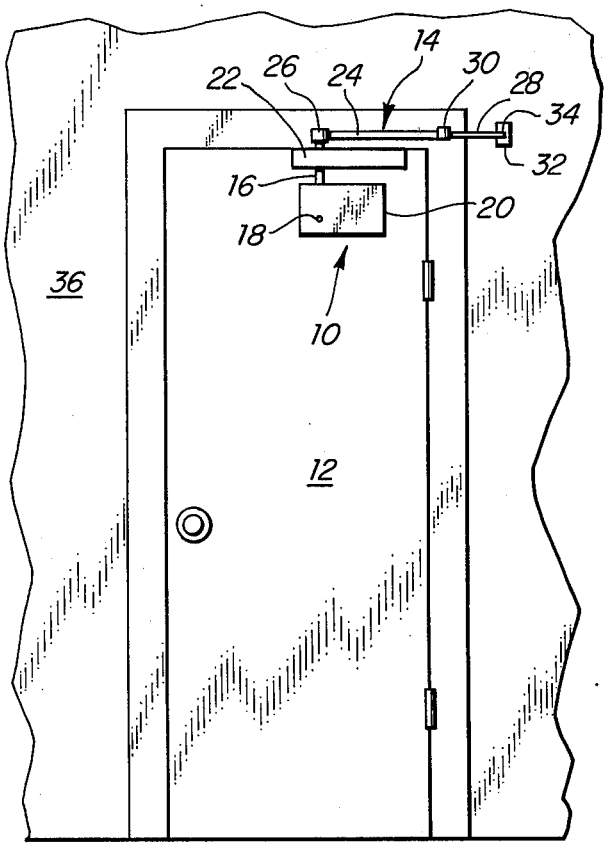
FIG. 1 is a diagrammatic illustration of a door-closer unit and fluid dispenser system according to this invention mounted on a door.

There is shown in FIG. 1 a fluid dispenser system 10 according to this invention mounted on a door 12. Fluid dispenser system 10 is driven by door-closer unit 14 by means of input shaft 16 to dispense fluid through hole 18 in its housing 20. Door-closer unit 14 includes closer mechanism 22, and arm 24 connected to mechanism 22 at shaft 26 and connected to a second arm 28 at pivot 30. Arm 28 is connected to mounting plate 32 by pivot 34 attached to wall 36. Door-closer unit 14 and various parts, as well as fluid dispenser system 10, may be fixed to the door 12 and wall 36 by screws or other conventional fastening means.

Figure 2:
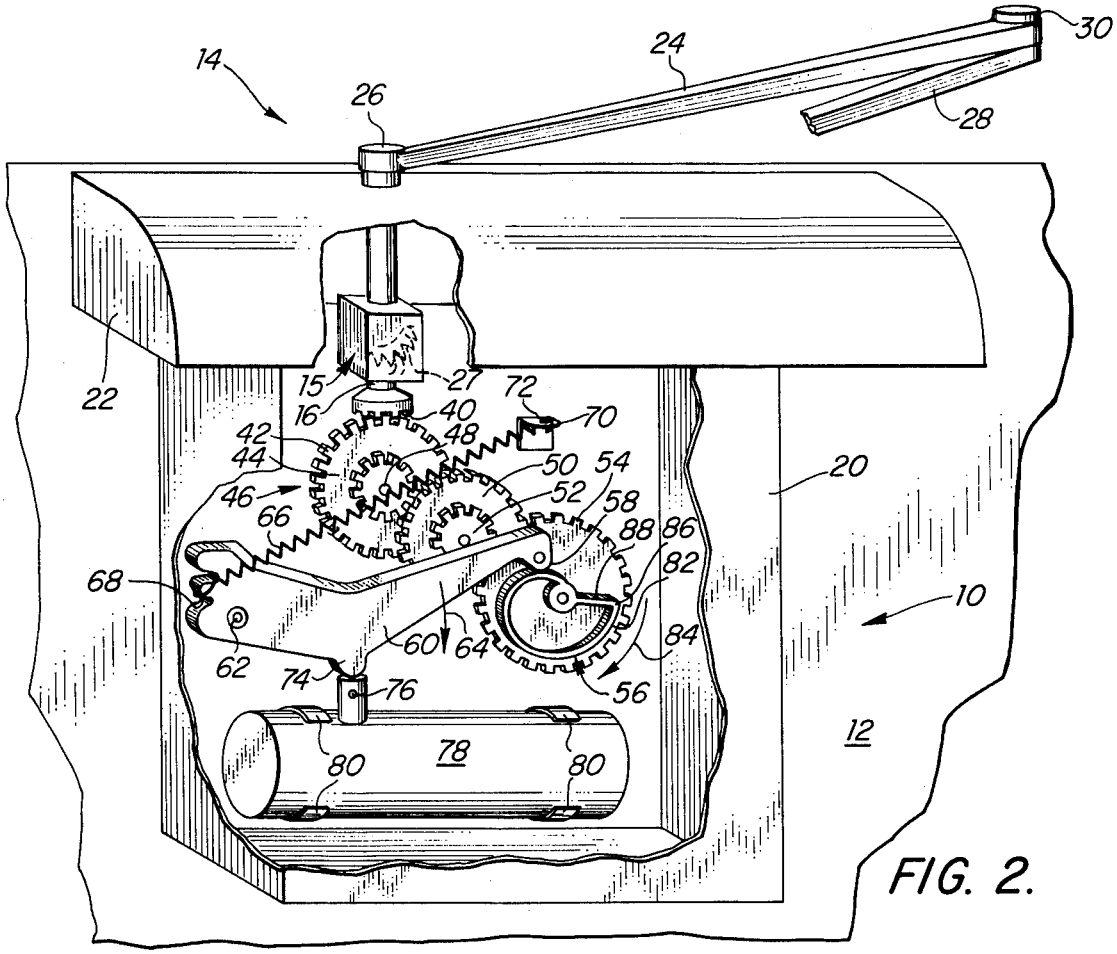
FIG. 2 is an axonometric view of a portion of a door-closer unit and a portion of the fluid dispenser system according to this invention with portions of the housing broken away.

Output shaft 26 in door-closer unit 14 is interconnected, FIG. 2, with input drive member 15, which includes ratchet 27 and input shaft 16 which contains on its lower end teeth 40 which engage with teeth 42 on the input drive gear 44 of drive unit 46. Drive unit 46 in this preferred embodiment also includes a second gear 48, fixed to a gear 44, and meshing with gear 50 fixed with gear 52 that drives the final gear 54 which carries cam 56 that engages camming surface 58 of actuator lever 60. Gears 42 and 48, 50, 52 and 54 are mounted and aligned by conventional means which are omitted here for simplicity. Actuator lever 60 is pivotally mounted to housing 20 by means of pin 62 and is biased downwardly in the direction of arrow 64 by means of spring 66 having one end engaged in slot 68 of lever 60 and the other end engaged in a hole 70 in bracket 72 which is fixed in housing 20.

Spring 66 urges actuator lever 60 in the direction of arrow 64 tending to drive detent 74 downwardly to operate nozzle 76 of aerosol dispenser 78 mounted in housing 20 by means of clips 80. The downward motion of actuator lever 60 is generally opposed by the high surface 82 of cam 56, which rotates in the direction of arrow 84. When cam 56 is rotated to the point where cam follower surface 58 passes over point 86 of cam 56, follower 58 drops along surface 88 toward the center of rotation of cam 56, causing detent 74 to drop and operate nozzle 76. Each time door 12, FIG. 1, is opened or closed, ratchet 27 causes input shaft 16 to rotate a quarter revolution in one direction; the quarter revolution motion is communicated through the drive unit 46 to rotate cam member 56 through one quarter of a revolution. Thus nozzle 76 is operated by detent 74 only once for each four operations of the associated door 12. Nozzle 76 may be moveable to permit adjustment of the spray direction.

Dispenser 78 may be implemented with a replaceable cartridge or a permanent cartridge with an easily accessible refill valve for replenishing the cartridge charge. It also may be desirable to include an indicator gauge to show the charge remaining in the cartridge.

Figure 3:
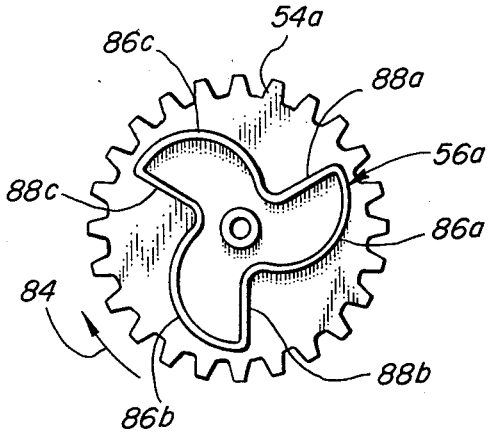
FIG. 3 is a diagrammatic illustration of an alternate construction of the cam member that may be used in the fluid dispenser system of this invention.

Various combinations of gear ratios and cam shapes may be used to vary the frequency of operation of nozzle 76 with respect to door openings and closings. For example, in FIG. 3, where like parts have been given like numbers accompanied by a lower case letter with respect to FIG. 1 and 2, cam **56*a* may have three high surfaces 86*a*, 86*b* and 86*c*, and three sharply dropping surfaces 88*a*, 88*b* and 88*c*, so that nozzle 76 is operated three times for each revolution of cam 56*a***, or three times for each four opening and closings of the associated door.

Figure 4:
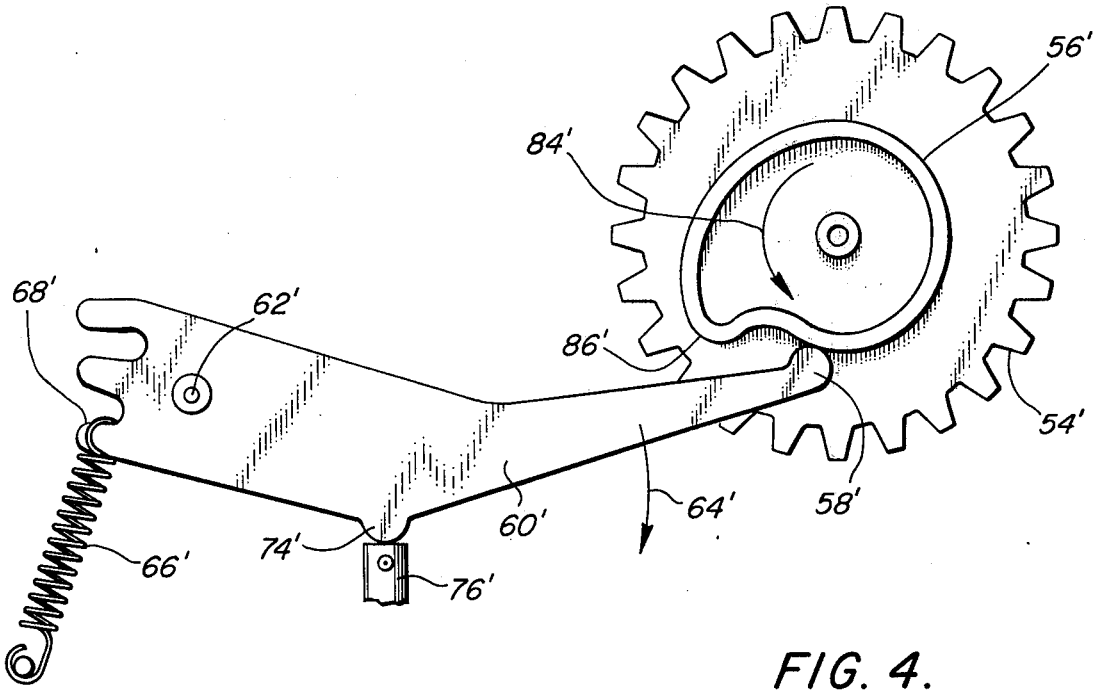
FIG. 4 is a diagrammatic illustration of another cam member which may be used in the fluid dispenser system according to this invention.

Although in FIG. 2 spring 66 urges actuator lever 60 toward operation of nozzle 76, while cam 56 opposes it, this is not a necessary limitation of the invention. For example in FIG. 4, where like parts have been given like numbers primed with respect to FIG. 1 and 2, cam 56' may be driven by gear 54' in the opposite direction of cams 56 and **56*a*, as indicated by arrow 84'. It may contain a high portion 86' which periodically drives actuator lever 60' downward in the direction of arrow 64', causing follower surface 58' to drive actuator lever 60' downwardly in the direction of arrow 64' against the force of spring 66', which in this instance is urging detent 74' away from nozzle 76'**.

Figure 5:
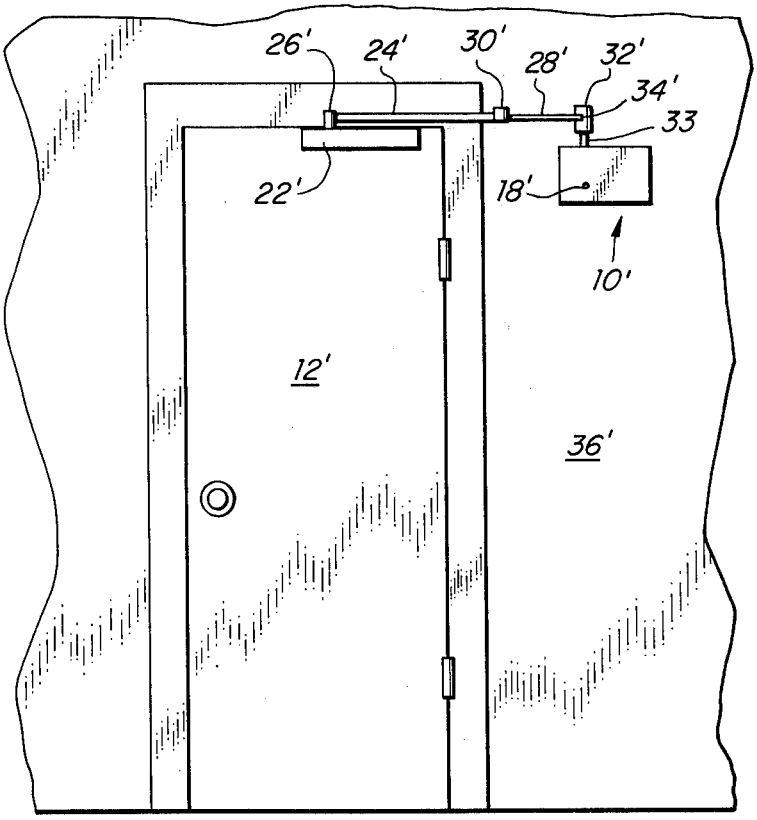
FIG. 5 is a diagrammatic illustration similar to FIG. 1 showing the fluid dispenser system of this invention mounted on the wall adjacent the associated door.

Although thus far in FIGS. 1 and 2 the fluid dispensing system and closer mechanism 22 have been shown mounted on door 12, this is not a necessary limitation of the invention. For example, as shown in FIG. 5, where like parts have been given like numbers primed with respect to FIGS. 1 and 2, fluid dispenser system 10' is fixed to wall 36' and is driven by output shaft 33 interconnected with arm 28' at pivot 34' at mounting plate 32'. In FIG. 5 closer mechanism 22' is fixed to door 12'.

Other embodiments will occur to those skilled in the art and are within the following claims:

What is claimed is:

1. A periodically activated fluid dispenser system, driven by a door-closer unit having an output shaft driven by motion of an associated door, comprising: a fluid dispenser container; a cam member; a follower member, responsive to said cam member, for activating said fluid dispenser container to dispense fluid at least once during each rotation of said cam member; an input drive member driven by said output shaft; a ratchet mechanism responsive to said input drive member for producing unidirectional rotary motion; and a gear train mechanism responsive to said unidirectional rotary motion output from said ratchet mechanism to drive said cam member through only a portion of a full rotation upon each operation of the output shaft.

2. The system of claim 1 in which said cam member includes a plurality of cam surfaces capable of actuating said cam follower actuator.

* * * * *